United States Patent [19]

Beam

[11] 4,225,136

[45] Sep. 30, 1980

[54] CONDENSED GOLF PLAYING AREA WITH CHANCE SELECTED STARTING LOCATIONS

[76] Inventor: Monte Beam, 512 West Berry Lake Rd., Port Orchard, Wash. 98366

[21] Appl. No.: 907,124

[22] Filed: May 18, 1978

[51] Int. Cl.[2] ..... A63B 69/36

[52] U.S. Cl. ..... 273/176 AB; 273/183 A

[58] Field of Search ..... 273/176 AB, 176 A, 176 L, 273/176 G, 33, 142 R, 195 A, 176 FB, 176 R, 176 AA, 176 B, 176 E, 176 F, 87 C, 87 R, 138 R

[56] References Cited

U.S. PATENT DOCUMENTS

| | | | |
|---|---|---|---|
| 2,003,074 | 5/1935 | Gage | 273/176 A |
| 2,894,749 | 7/1959 | Rook | 273/176 E |
| 3,399,899 | 9/1968 | Shepherd | 273/195 A X |
| 3,584,877 | 6/1971 | Florian | 273/176 FB |
| 3,820,786 | 6/1974 | Candor | 273/176 L X |
| 3,904,209 | 9/1975 | Thomas | 273/176 B X |
| 3,999,764 | 12/1976 | Nitsche | 273/176 AB |
| 4,017,084 | 4/1977 | Jeffery | 273/176 FB |
| 4,063,738 | 12/1977 | Michalson | 273/176 A |

*Primary Examiner*—George J. Marlo

*Attorney, Agent, or Firm*—Cole, Jensen & Puntigam

[57] ABSTRACT

The structure includes a base surface which is divided up into a plurality of relatively narrow, substantially rectangular portions which are arranged in a substantially grid-like pattern. Each portion includes a putting green surface region which includes a hole adapted to receive a conventional golf ball. Nearly all of the portions include a combination of one or more of the following surface regions in addition to the putting green surface region: a water hazard region, a sand hazard region, a rough region, and a fairway region. Obstacles may be present in one or more portions and the terrain of the portions may vary. A starting area is provided on a selected one of the surface regions of each portion. Each portion resembles a narrow slice of the approach area to a putting green on a conventional golf course, thereby permitting the use of conventional golf clubs and strokes on the portions, in addition to the putter and putting stroke, by the player as he/she moves the ball from the starting area to the hole of each portion. The starting area for each portion may include number markers which designate various starting locations for the player within the starting area. A random number generator is provided to determine a player's starting location for each hole.

15 Claims, 7 Drawing Figures

| HOLE | STARTING POINT |
|---|---|
| 1 | 2 |
| 2 | 7 |
| 3 | 10 |
| 4 | 5 |
| 5 | 9 |
| 6 | 1 |
| 7 | 8 |
| 8 | 11 |
| 9 | 2 |
| 10 | 6 |
| 11 | 10 |
| 12 | 4 |
| 13 | 9 |
| 14 | 3 |
| 15 | 5 |
| 16 | 12 |
| 17 | 1 |
| 18 | 7 |

CONDENSED GOLF PLAYING AREA WITH CHANCE SELECTED STARTING LOCATIONS

BACKGROUND OF THE INVENTION

The present invention relates generally to a golfing structure, and more particularly concerns such a structure which is divided into relatively narrow portions which in turn include conventional or simulated putting green surface regions, hazard surface regions and fairway surface regions, so that each portion presents a particular approach shot to the player.

Conventional golf is a very popular sport in the United States and is played by virtually all age groups, and by both men and women. The popularity of golf has increased over the past several decades, and is expected to increase further in the immediate future. The number of people who now play golf, however, are placing a significant strain on the available golf facilities, particularly the full-size public courses. Players often encounter long delays, and maintenance problems are increasing, due to the increased use of the courses.

When golf began to increase in popularity several decades back, land was relatively inexpensive and readily available, so that a full-size golf course could be built at a relatively reasonable cost. Over a relatively long period, the number of conventional golf facilities steadily increased. However, in recent times, the building of conventional golf courses has declined, due to rising costs, until today, relatively few full-size courses are being built, particularly in or near metropolitan areas, as the land required is either no longer available in those areas, or is too expensive to use for a golf course.

Under conditions of increasing playing demand, without a corresponding increase in the number of courses, the pressure on existing courses will increase still further, resulting in ever longer playing delays and more difficult maintenance problems.

In addition to the full-size golf courses, there exist scaled-down, or short, courses, usually par 3 or executive courses, which have become increasingly popular, particularly because of the shorter period of time required to play the course. So-called miniature golf courses, which are essentially amusement games in which the player uses only a putter, are also popular, although they bear little resemblance to the conventional game of golf.

The par 3 and executive courses, while bearing some resemblance to full size, conventional golf courses, and having the advantage of requiring significantly less land area than conventional courses, are usually either too simple and/or too repetitive to present a real challenge to the avid golfer, i.e. they do not present normal playing situations encountered by a golfer on a full-size conventional course. Hence, such courses are not patronized to the same extent as are full-size courses.

Accordingly, it is a general object of the present invention to provide a golf structure which overcomes one or more of the disadvantages of the prior art noted above.

It is another object of the present invention to provide such a golf structure which presents to a player situations similar to that found on a conventional course.

It is an additional object of the present invention to provide such a golf structure which avoids the repetitive nature of scaled-down golf courses.

It is yet another object of the present invention to provide such a golf structure which requires significantly less playing area than a conventional golf course, while permitting the player to use coventional golf clubs and strokes other than the putter and putting strokes.

SUMMARY OF THE INVENTION

Accordingly, the present invention is a golf structure which includes a base surface and means dividing the base surface into a plurality of relatively narrow portions. Positioned on each of said portions is a playing surface means which simulates, in substantially full size, a narrow section of an approach area of a coventional golf hole, so that each of said plurality of relatively narrow portions, with their accompanying playing surface means, presents a coventional golf approach shot to a player.

In the embodiment disclosed herein, each playing surface means includes a putting green region which in turn includes a hole adapted to receive a golf ball, and a majority of said playing surface means includes at least one of the group of playing surface regions consisting of: a water hazard region, a sand hazard region, a rough hazard region, and a fairway region.

DESCRIPTION OF THE DRAWINGS

A more thorough understanding of the present invention may be obtained by a study of the following detailed description taken in connection with the accompanying drawings in which.

DESCRIPTION OF PREFERRED EMBODIMENT

Figure 1:
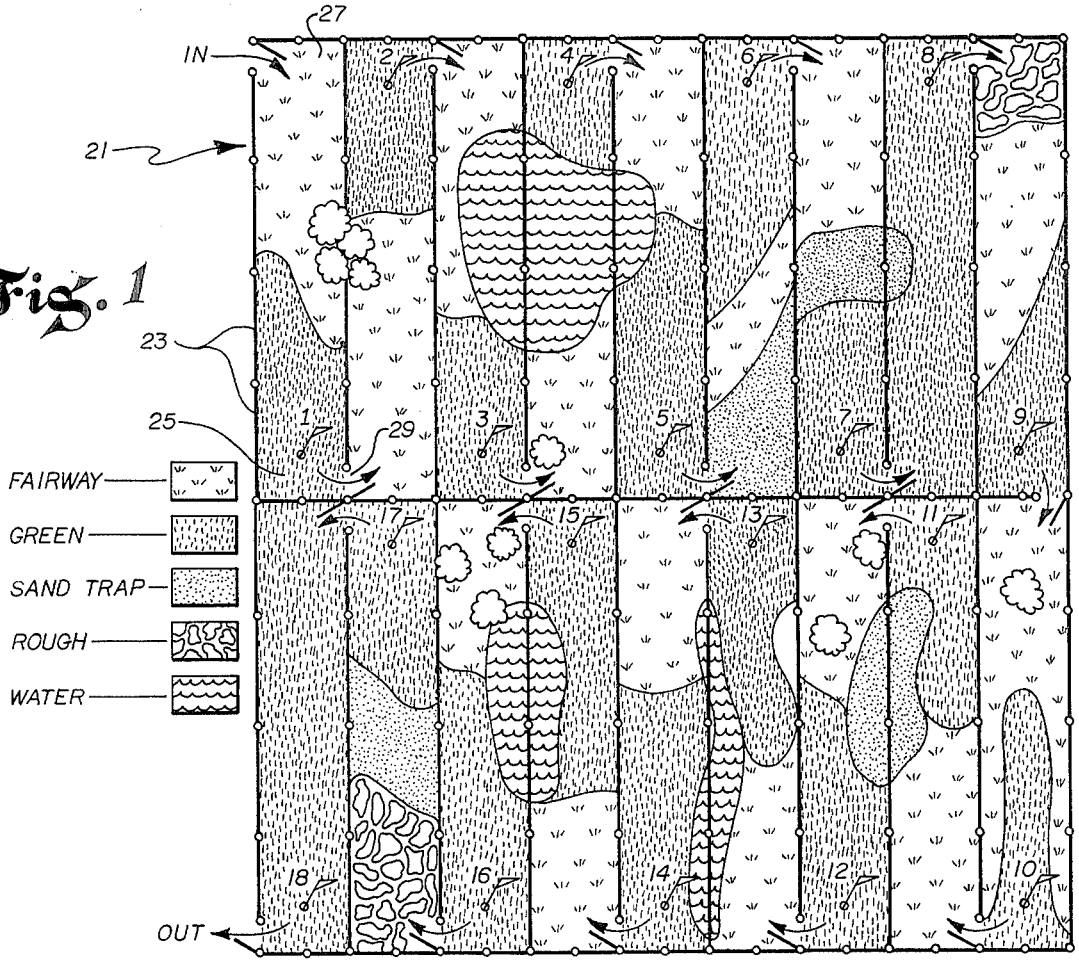
FIG. 1 is a plan view of a golf structure embodying the principles of the present invention.
Figure 3A:
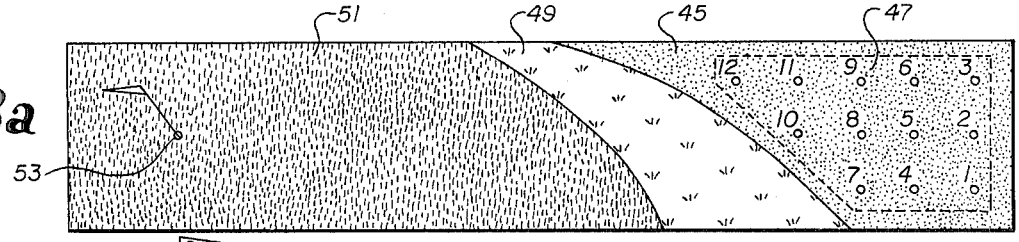
FIGS. 3*a* and 3*b* are detailed plan and side elevational views, respectively, of another portion of the golf structure of FIG. 1.
Figure 3B:
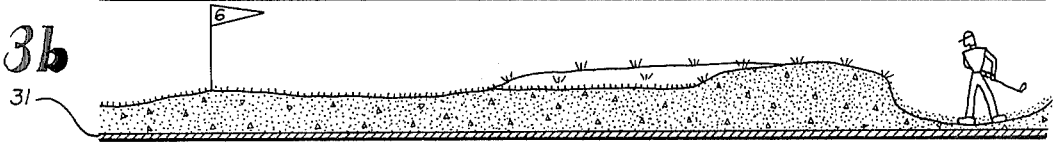

One golf structure which embodies the principles of the present invention is illustrated in FIG. 1. The structure is substantially square in outline, and includes a base surface shown generally at 21, which is divided into a number of portions shown at 1–18. Each portion 1–18 comprises a separate playing entity in the structure and hence, each portion may be referred to commonly as a "hole". Although eighteen holes are shown in the structure of FIG. 1, it should be understood that other structures embodying the principles of the present invention may incorporate a different number of holes than that shown.

The base surface 21 may be earthen, or it may be an artificial surface, such as asphalt, concrete, wood, or rigid plastic. The structure in the embodiment shown is bounded by a fence 23, which is high enough to prevent most golf balls struck by players using the structure from escaping the structure. A roof may be provided for the structure, so that the play may be indoors, or the structure may be exposed to the atmosphere.

Each portion 1–18 of the embodiment shown is substantially completely bounded by a fence, similar to fence 23, which provides the necessary protection and separation for each hole, and prevents golf balls struck by players from escaping into neighboring holes.

As an alternative to fence 23 and the fence bounding the individual holes, some other protective or partitioning means, such as a high hedge, or even trees, could be utilized to define the boundaries of the structure and the individual holes, and to provide the necessary restraint for errant shots.

Each portion 1–18 is configured to resemble a relatively narrow slice of an approach shot to a putting green of a conventional golf hole on a full-size golf course. A player on a full-size course will normally encounter a variety of surface regions as he/she plays the course. This is particularly true in the approach area of each hole, which is the area between the green and a line approximately 120 yards from the green.

In this area the player is shooting to land on the green and expects to land fairly close to the hole. Within this area, the player may encounter a variety of shot situations, including a chip shot, a pitch-and-run shot, a bunker shot, and a wedge shot.

Furthermore, these shots may be of varying distance. In this area, the player will encounter a variety of surface regions, depending on his location, relative to the green, including fairway surface regions, rough surface regions, and sand and water regions. Additionally, the terrain on this approach area usually varies to some extent, and obstacles, such as shrubs and trees are usually present.

The portions of the present structure are each arranged to present a particular shot to the player which he might encounter in the approach area of a hole in a full-size course. Each hole of the present structure thus is a narrow slice of an approach area to a hole on a conventional golf course. On a given hole of a conventional golf course, the player may encounter one of a multitude of possible close approach shots to the green, depending on where his previous shots have landed, and a variety of surface regions, obstacles, and terrain conditions in the approach area.

In the structure of the present invention, however, each portion or hole is arranged to present a particular approach shot to a green. Each portion of the structure is thus a narrow slice of a portion of a typical approach area to a green on a full-size course. Each portion 1–18 of the present structure thus is sufficiently long and wide, i.e. approximately 50–360 feet long and 20–50 feet wide, so that it accurately presents a particular approach shot which might be encountered on a full-size course. Each portion 1–18 includes a narrow section of a putting green surface region and a hole therein adapted to receive a conventional golf ball. The putting green surface region is usually, but not necessarily, located at one end, i.e. end 25 of portion 1, of each portion. In some portions, the putting green surface region may be located in other locations, such as the middle of the portion, for instance.

Besides the putting green surface region, most other portions will include a combination of additional surface regions, such as fairway, sand, rough and water, as well as obstacles such as shrubs and trees. In addition, the terrain of each portion may be irregular, all of which combine to simulate a particular approach shot normally encountered by a player on a conventional golf course.

Although most portions 1–18 will include several different surface regions in addition to the putting green region, one or more portions may be entirely putting green or may include just one additional surface region. This is to present to the player either an extremely long putting situation or a long shot from a sand trap, for instance. In one area of each portion, such as end 27 in portion 1, a starting area is provided. In playing the golf structure of the present invention, the player will attempt to move a ball, which usually is a conventional golf ball, from a defined point in the starting area to the hole, using conventional golf clubs and strokes. It is conceivable, however, that the structure of the present invention could utilize other kinds of balls, such as a perforated whiffletype ball.

In the embodiment shown, each of the portions 1–18 are the same size, in the form of rectangles substantially longer than they are wide, i.e. approximately 90 feet long and 20 feet wide. The portions are arranged in two rows, with the top edges of the lower row of portions being presented adjacent the bottom edges of the upper row of portions. The portions comprising each row are positioned adjacent to each other along their long sides, with the starting end of each portion rotating end-to-end between adjacent portions, so that a player moves directly from the hole of one portion to the starting area of another portion. Such an arrangement results in the grid-like structure of FIG. 1, which is extremely compact, and requires relatively little ground area compared to a full-size golf course.

It should be understood, however, that the present invention is not limited to the grid-like pattern disclosed, although such a pattern may be preferred in certain applications. It is important, however, that each individual portion comprise one or more playing surface regions, arranged on a base surface, wherein each portion is relatively narrow, so that a particular approach shot to the hole is presented to the player by each portion.

In playing on the structure of the present invention, a player will encounter a wide variety of situations which will challenge his full golf ability and skill. On the other hand, the situations are not so difficult as to be impossible for the less skilled. The capability of the structure of the present invention to accommodate varying skill levels is enhanced by having starting points of varying difficulty in a given portion, which is explained in more detail in following paragraphs.

Depending on the portion, a player may start in a hazard, i.e. sand or rough, or he may start on fairway or even on a putting green. He may have to shoot over water, sand, and obstacles such as trees and shrubs. His vision of the hole in the putting green region may be obscured or even blocked by trees or the terrain. He may encounter side hill, down hill or up hill lies, depending on the terrain of the hole. He will encounter various green conditions and configurations.

The combination of surface regions, obstacles and terrain of each portion is designed to duplicate a particular shot condition found within an approach area in a conventional golf hole. Hence, conventional golf clubs, strokes and techniques are necessary for proper play on the structure of the present invention.

In use of applicant's structure, each player in turn will begin each hole in the designated starting area of each portion, and will attempt to move his ball into the hole on the putting green region, which is usually at the opposite end of the portion. After completion of each portion, he will move through an opening in the wall or fence bounding that portion, i.e. opening 29 between portions 1 and 2 in FIG. 1, to the next portion, the starting area of which will usually be immediately presented to him. Movement of a player through the structure of FIG. 1 is illustrated by the arrows.

Figure 2A:
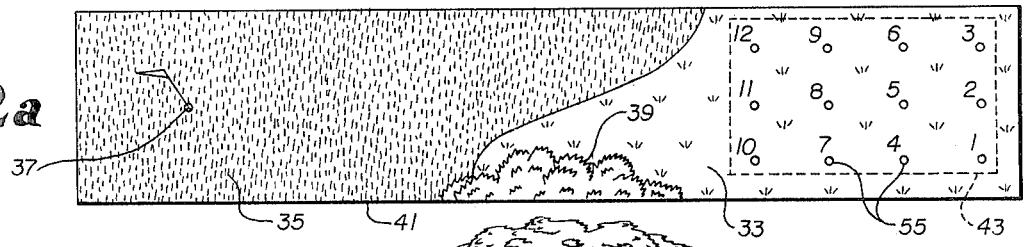
FIGS. 2*a* and 2*b* are detailed plan and side elevational views, respectively, of one portion of the golf structure of FIG. 1.
Figure 2B:
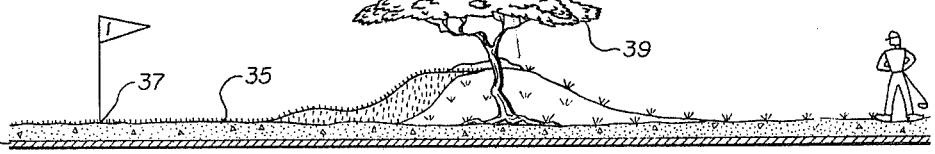

The structure of the various portions 1–18 is more clearly illustrated in FIGS. 2, *2a* and 3, *3a*. Each portion 1–18 will include a section 31 of the base surface of the structure, which supports the various playing surface regions. Each portion will include boundary walls which substantially surround the perimeter of each portion, to prevent golf balls from escaping from each portion, which might otherwise be the case because of an errant shot. The wall may be a fence, or natural protection such as shrubs or trees.

FIGS. *2a* and *2b* show portion 1 of FIG. 1 in detail in plan and side elevation views, while FIGS. *3a* and *3b* show portion 6 in similar detail. These portions are representative of the portions comprising the structure of FIG. 1, which generally each include a number of playing surface regions, with the exception of portion 18, which is completely putting green.

Referring now specifically to FIGS. *2a* and *2b*, the portion shown therein comprises a fairway region 33 and a putting green region 35, which includes a hole 37. These regions are on top of the base surface. A small tree 39 serves as an obstacle near one side 41 of the portion, and the terrain in the vicinity of the tree is irregular, somewhat obscuring the player's vision of the green from the starting area 43, which is shown in dotted lines. This portion is designed to duplicate a particular approach shot to the green, from a fringe fairway region, over a hump, to a sloping green. Such a shot is commonly referred to as a chip shot.

FIGS. *3a* and *3b* show portion 6, which comprises, in sequence, a sand hazard region 45, which includes a designated starting area 47 in dotted lines, a fairway region 49, and a putting green region 51, with a hole 53. The region 45 covers a large section, approximately 35%, of the portion, while the putting green region covers approximately 50%. The fairway region 49 is a relatively narrow, curving strip between regions 45 and 51. There are no obstacles in this portion, and the terrain is fairly even, although the sand region 45 is somewhat below the adjacent fairway or fringe region 49. This portion presents a sand shot to the player, since the starting area is completely within region 45.

The remaining portions of the structure comprise various combinations of playing surface, regions, obstacles and varying terrain so as to present to the player a multitide of approach shot situations encountered on a conventional golf course.

In one embodiment of the invention, such as in FIGS. *2a* and *2b*, *3a* and *3b*, the starting area of each portion is quite large, and there may be positioned various markers 55-55 therein (FIG. *2a*), which designate various starting locations for the player within the starting area. Further, the playing surface regions, obstacles and terrain of the portions may be arranged so that the starting points vary in difficulty, because of their spatial relationship to obstacles or terrain features, relative to the hole in the green. In some instances, the starting points may encompass different playing surface regions.

A player will be given a score card when he begins play on the structure shown and described herein, and a particular starting position for each portion will be indicated, with a space for entry of the score for that portion. The array of starting point numbers for a particular scorecard could be produced by a random or pseudo-random number generator, so that it would be virtually impossible for a player to have the same pattern of starting points in any two rounds he plays on the structure. Thus, the structure changes, to a certain extent, each time a player uses the structure, avoiding the disadvantage of repetition so common in existing short golf courses.

Figures 4, 5:
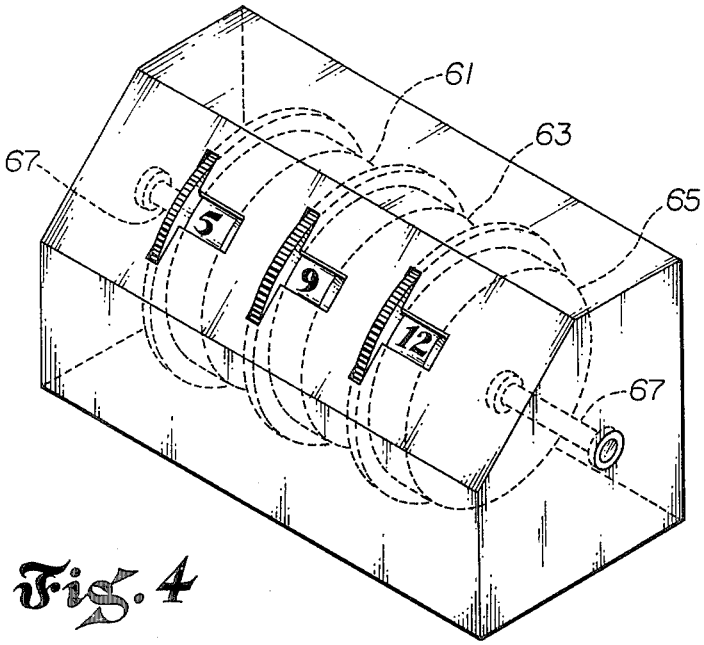
FIG. 4 is a front elevational view of a simple mechanical embodiment of the device producing weighted starting points for the structure of FIG. 1.
FIG. 5 is a portion of a sample printout of a starting point array.

Additionally, the array of starting locations could be weighted, by a suitable mechanical selection or programming technique, to produce different arrays of starting points grouped by difficulty. Thus a player could advance between different levels of difficulty, using the same course. A simple means for accomplishing the weighted array of random start points is shown in FIG. 4. Assuming that three levels of difficulty is desirable, three mechanical wheels 61, 63, 65 could be provided, each with a set of numbers thereon which represent a selection of starting points which correspond to a given range of difficulty.

Hence, the starting point numbers on wheel 61, which represents the most difficult grouping, are those start points in each portion which in total represents the highest group of difficulty for each portion.

A starting point number array, such as shown in FIG. 5, may then be produced by successively rotating the wheel 61, which is mounted on shaft 67 for free rotation. The number showing in the associated window at the conclusion of each rotation is the starting point for each successive portion.

Other means, of course, could be used to produce such weighted arrays of starting points. One such means would be a random or pseudo-random number generator which is programmed, by means of various feedback routines, to produce arrays weighted by difficulty.

The present invention thus is a golf structure which presents a challenge to the skilled golfer without overwhelming the lesser skilled. The player typically will use a full selection of approach shot skills similar to that used on a conventional golf course. The golf structure includes a base surface and boundary walls which divide the structure into individual portions, with each portion comprising a separate, divisible part of the whole structure.

Each portion comprises a particular combination of playing surface regions, as well as obstacles and varying terrain, and presents to the player a particular approach shot to a putting green and hole similar to that encountered on a conventional course. Each portion is relatively narrow, however, so that only one particular approach situation is presented per portion, unlike a conventional course, which presents a multitude of follow-on possible shots in each approach shot situation. The structure may be indoors, under a roof, and may utilize artificial materials instead of grass and natural trees, or it may be outdoors and use natural surface region materials. Since each portion is relatively compact, and may be arranged with other portions in a compact grid-like pattern, a structure having a large number of portions, i.e. 18, may be contained in an area covering a few acres, or even less, of ground.

Although an exemplary embodiment of the invention has been disclosed herein for purposes of illustration, it should be understood that various changes, modifications and substitutions may be incorporated in such embodiment withtout departing from the spirit of the invention as defined by the claims which follow.

What is claimed is:

1. A structure for golf, comprising:

a base surface;

means dividing said base surface into a plurality of portions wherein said dividing means includes boundary means which extends substantially completely around each portion and which extends sufficiently to generally maintain a conventional golf ball which is used in playing a given portion within the confines of said portion;

playing surface means, positioned on each of said portions, for simulating, in substantially full size, a narrow section of an approach area of a conventional golf hole, so that each said portion and said playing surface means presents a conventional golf approach shot to a player; wherein each playing surface means includes a starting area, and wherein at least one of the holes contains a starting area which includes a sand hazard region, at least one of the holes contains a starting area which includes a rough hazard region, and at least one of the holes contains a starting area which includes a fairway region, said playing surface means further including a plurality of designated starting points within each said starting area, said starting points presenting varying levels of difficulty for the player in his attempt to move a golf ball from the starting area to the hole, each of said starting points being designated by a symbol; and means for producing a substantially random set of said symbols for the player each time he uses the structure, wherein said random set includes a symbol for each of said portions designating the starting point for that portion.

2. A structure of claim 1, wherein said playing surface means includes a putting green surface region which in turn includes a hole adapted to receive a golf ball, and wherein a majority of said portions further includes at least one of the group of playing surface regions consisting of: a water hazard region, a sand hazard region, a rough hazard region and a fairway region.

3. A structure of claim 1, wherein said symbols are numbers.

4. A structure of claim 1, including means for producing at least two levels of sets of symbols, each of said levels corresponding to a different level of difficulty.

5. A structure of claim 1, wherein a majority of said playing surface means further includes obstacles positioned between the starting area and the putting green surface region.

6. A structure of claim 5, wherein the playing surface means on a majority of said portions vary in elevation between the starting area and said putting green surface region.

7. A structure of claim 6, wherein each of said portions is substantially the same size.

8. A structure of claim 1, wherein each portion is substantially rectangular in plan, and wherein one dimension thereof is approximately at least two and one-half times as long as the other dimension.

9. A structure of claim 8, wherein said one dimension is at least 50 feet and said other dimension is at least 20 feet.

10. A structure of claim 9, wherein said portions are arranged in a grid-like pattern, comprising at least one row of side-adjacent portions.

11. A structure for golf, comprising:

a base surface;

playing surface means, positioned on said base surface for dividing said base surface into a plurality of portions each portion simulating, in substantially full size, a section of a conventional golf hole, each portion including a putting green surface region which in turn includes a hole adapted to receive a golf ball, a majority of said portions including in addition, at least one of the group of playing surface regions consisting of: a water hazard region, a sand hazard region, a rough hazard region, and a fairway region, each playing surface portion further including a plurality of designated starting points, said starting points presenting varying levels of difficulty for the player in his attempt to move the golf ball from a starting point to the hole in the putting green surface region, each of said starting points being designated by a symbol; and means for producing a substantially random set of said symbols for the player each time he uses the structure, wherein said random set includes a symbol for each of said playing surface portions designating the starting point for that portion.

12. A structure of claim 11, including means for producing at least two levels of sets of symbols, each of said levels corresponding to a different level of difficulty.

13. A structure of claim 11, wherein a majority of said playing surface portions include obstacles positioned between the starting points and the putting green surface region.

14. A structure of claim 11, wherein said playing surface portions are relatively narrow, thereby simulating a narrow section of a conventional golf hole, each portion being substantially rectangular in plan and arranged relative to each other so that the structure is rectangular in configuration, approximately at least four times as long as it is wide.

15. An apparatus of claim 1, including means for covering said structure, so that said structure can be used during inclement weather.

* * * * *

UNITED STATES PATENT AND TRADEMARK OFFICE

CERTIFICATE OF CORRECTION

PATENT NO. : 4,225,136

DATED : September 30, 1980

INVENTOR(S) : Monte Beam

It is certified that error appears in the above-identified patent and that said Letters Patent are hereby corrected as shown below:

Claim 11, line 5, A comma should be inserted between the words "portions" and "each".

Claim 15, line 1, the numeral "1" should be --11--.

Signed and Sealed this

*Ninth* Day of *December 1980*

[SEAL]

*Attest:*

SIDNEY A. DIAMOND

*Attesting Officer*

*Commissioner of Patents and Trademarks*